US006344622B1

(12) United States Patent
Takiguchi et al.

(10) Patent No.: US 6,344,622 B1
(45) Date of Patent: Feb. 5, 2002

(54) SWITCH DEVICE

(75) Inventors: Shuji Takiguchi; Toshifumi Kobayashi; Atuyoshi Yamaguchi, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 144 days.

(21) Appl. No.: 09/626,908

(22) Filed: Jul. 27, 2000

(30) Foreign Application Priority Data

Jul. 28, 1999 (JP) ..... 11-213930

(51) Int. Cl.[7] ..... H01H 9/00
(52) U.S. Cl. ..... 200/314; 200/5; 200/315
(58) Field of Search ..... 200/5 R, 5 A, 200/293, 303, 302.1–302.3, 339, 335, 313–315

(56) References Cited

U.S. PATENT DOCUMENTS 4,791,258 A * 12/1988 Youtz et al. ..... 200/302.1
5,036,168 A * 7/1991 Kikuchi et al. ..... 200/5 R
5,734,136 A * 3/1998 Newcomer et al. ..... 200/5 A
5,804,780 A * 9/1998 Bartha ..... 200/5 A

FOREIGN PATENT DOCUMENTS

JP 6-290685 * 10/1994
JP 9-198176 7/1997 ..... G06F/3/02

* cited by examiner

*Primary Examiner*—Michael C. Gattner
*Assistant Examiner*—Nhung Nguyen
(74) *Attorney, Agent, or Firm*—Sughrue, Mion, Zinn, Macpeak & Seas, PLLC

(57) ABSTRACT

A switch device includes a key member (4). The key member (4) has a display switch button (13) including a transparent portion through which image information displayed on a display screen of an image display device is transmitted so as to display the image information on an outer side surface of the key member (4). Further, the key member (4) has a button mounting frame (16) including a switch depressing portion (14) operative to switch a switch (6) when the key depressing portion (14) is depressed, and having a button mounting hole portion to which the display switch button (13) is attached. Furthermore, the key member (4) has a waterproof dust cover (19) of a rubber material, which is molded integrally on the button mounting frame (16) to cover the same, and which includes a support portion (17) held in intimate contact with the display screen, and a contractible skirt portion (18). A plurality of resin filling holes are formed in the button mounting frame. The rubber material, forming the waterproof dust cover (19), is filled in the resin filling holes.

10 Claims, 6 Drawing Sheets

SWITCH DEVICE

BACKGROUND OF THE INVENTION

1. Field of the Invention

The present invention relates to a switch device for operating, for example, an audio system, an air conditioning system and so on in a vehicle. More particularly, the present invention relates to a switch device employing key members each capable of transmitting image information, displayed on a display screen of an image display device, therethrough so as to display this image information on an outer side (outer surface) of the key member.

The present application is based on Japanese Patent Application No. Hei. 11-213930, which is incorporated herein by reference.

2. Description of the Related Art

In most of conventional switches used, for example, in an on-board radio cassette deck, characters or the like, indicating button functions, are printed directly on operating buttons. Therefore, in a multi-function radio cassette deck or the like, it has been necessary to prepare the operating buttons in accordance with the various functions, and it has also been necessary to indicate two functions on one operating button by printing.

With this construction, however, the number of the operating keys increases, so that the equipment (radio cassette deck or the like) has an increased size, and besides a plurality of functions are indicated by printing on the same operating button, which invites a problem that the characters or the like thereon can not be clearly recognized.

In order to solve these problems, there has been proposed a switch device in which operating buttons, each having a transparent window portion, are arranged on a display screen of a liquid crystal display, and button function-indicating characters or the like, displayed on the display screen, are transmitted through the transparent window portion to the outer side of the operating button. Such a switch device is disclosed, for example, in Unexamined Japanese Patent Publication No. Hei. 9-198176.

As shown in FIG. 11, in such an electronic equipment, a liquid crystal display 102 and a switch 103 are mounted on a printed circuit board 101, and a front panel 104 is provided to cover the liquid crystal display 102 and other parts, and operating buttons 106, each having a transparent window portion 105, are mounted on the front panel 104. Button function-indicating characters or the like, displayed on a display screen 107 of the liquid crystal display 102, are displayed on the outer side (outer surface) of the operating button 106 through the transparent window portion 105.

In the electronic equipment of the above construction, a receive frequency, an operating condition and so on are displayed on an upper portion of the display screen 107 whereas the button functions of the operating buttons 106 are displayed on a lower portion of the display screen 107, and this displayed button function can be recognized through the transparent window portion 105 with the eyes.

Therefore, in this electronic equipment, it is not necessary to indicate the button functions on the operating buttons by printing, and the functions of the operating buttons can be indicated, utilizing the display device for displaying the operating condition of the equipment and so on. And besides, each operating button can have a plurality of functions (to provide a so-called multi-switch design), and therefore it is not necessary to increase the number of the operating buttons, and the switch device can have a compact size.

In the electronic equipment of the above construction, however, when dirt, dust, a water droplet or other foreign matter, intrudes into the interior of the switch device through a gap between the operating buttons 106, and is disposed between the display screen 107 and the operating button 106, the user can recognize this foreign matter (such as dust, dirt and a water droplet) through the transparent window portion 105. Namely, part of the operating button 106 is transparent, and therefore there is a drawback that the foreign matter (such as dust, dirt and a water droplet), which has intruded into the interior, can be viewed. In addition, there is not provided any means which enables the use to remove the foreign matter (such dust and dirt) which has intruded into the gap between the display screen 107 and the operating button 106.

SUMMARY OF THE INVENTION

Therefore, the present invention has been made in order to solve the above problems, and an object of the present invention is to provide a switch device in which a foreign matter (such as dust, dirt and a water droplet) is positively prevented from intruding into a gap between an display switch button and a display screen from the outer periphery of the display switch button.

To achieve the above object, according to the first aspect of the present invention, there is provided a switch device which comprises a key member located above a display screen of an image display device which is capable of displaying image information on the display screen, the key member being capable of transmitting the image information therethrough so as to display the image information on an outer side surface thereof, the key member comprising a display switch button, a button mounting frame, which includes a switch depressing portion operative to switch a switch when the key depressing portion is depressed, and which has a button mounting hole portion to which the display switch button is attached, and a waterproof dust cover of a rubber material, which is molded integrally on the button mounting frame to cover the button mounting frame, and which includes a support portion held in intimate contact with the display screen, and a contractible skirt portion, wherein a plurality of resin filling holes are formed in the button mounting frame, and wherein the rubber material, forming the waterproof dust cover, is filled in the resin filling holes.

Accordingly, since the support portion of the waterproof dust cover is held in intimate contact with the display screen, the waterproof dust cover prevents the intrusion of a foreign matter, such as dust, dirt and a water droplet, into a gap between the display screen and the display switch button.

In the above construction, the plurality of resin filling holes are formed in the button mounting frame, and the rubber material, forming the waterproof dust cover, is filled in the resin filling holes. With this construction, the button mounting frame of the resin and the waterproof dust cover of the rubber material, which are usually not bonded together, are firmly combined together to provide an integral construction. Thus, the button mounting frame and the waterproof dust cover are combined into an integral construction, and therefore the efficiency of the assembling operation is enhanced.

According to the second aspect of the present invention, the display switch button may include a transparent portion through which the image information is transmitted so as to display the image information on the outer side surface of the key member.

According to the third aspect of the present invention, it is preferable that the button mounting frame is associated with the display switch button to switch the switch.

According to the fourth aspect of the present invention, it is preferable that the display switch button is press-fitted in the button mounting hole portion covered with the rubber. The display switch button is press-fitted in the button mounting hole portion covered with the rubber, and therefore the display switch button is held in intimate contact with the rubber at this press-fitted portion, so that the intrusion of a foreign matter, such as dirt, dust and a water droplet, through this press-fitted portion, is prevented.

According to the fifth aspect of the present invention, it is preferable that a heat-resistance temperature of a resin material, forming the button mounting frame, is higher than a heat-resistance temperature of the rubber material forming the waterproof dust cover. The button mounting frame is formed by the resin material whose heat-resistance temperature is higher than that of the rubber material forming the waterproof dust cover, and therefore the integrally-molded structure can be obtained in a rubber-molding mold. And besides, the display switch button is prevented from becoming uneven in thickness, and therefore the molding can be carried out easily. Generally, a transparent resin material exhibits a low resistance to an impact, and therefore the reliability of the switch itself can be enhanced by the use of the separate button mounting frame.

Furthermore, to achieve the above object, according to the sixth aspect of the present invention, there is provided a switch device which comprises a key member located above a display screen of an image display device which is capable of displaying image information on the display screen, the key member being capable of transmitting the image information therethrough so as to display the image information on an outer side surface thereof, the key member comprising a display switch button, a button mounting frame, which includes a switch depressing portion operative to switch a switch when the key depressing portion is depressed, and which is molded integrally on an outer periphery of the display switch button, and a waterproof dust cover of a thermoplastic elastomer, which is molded integrally on the button mounting frame to cover the button mounting frame, and which includes a support portion held in intimate contact with the display screen, and a contractible skirt portion, wherein a plurality of resin filling holes formed in the button mounting frame, and the thermoplastic elastomer is filled in the resin filling holes. Accordingly, since the support portion of the waterproof dust cover is held in intimate contact with the display screen, the waterproof dust cover prevents a foreign matter, such as dust, dirt and a water droplet, from intruding into the gap between the display screen and the display switch button. Furthermore, since the waterproof dust cover is made of the thermoplastic elastomer, the display switch button and the button mounting frame, which are integrally molded together, will not melt when molding the waterproof dust cover.

The plurality of resin filling holes are formed in the button mounting frame, and the thermoplastic elastomer, forming the waterproof dust cover, is filled in the resin filling holes. Therefore, the button mounting frame of the resin and the waterproof dust cover of the rubber material, which are usually not bonded together, are firmly combined together through this thermoplastic elastomer to provide an integral construction. Thus, the button mounting frame and the waterproof dust cover are combined into an integral construction, and therefore the efficiency of the assembling operation is enhanced.

According to the seventh aspect of the present invention, it is preferable that the skirt portion is smaller in thickness than a remaining portion of the waterproof dust cover. Accordingly, when the display switch button is pressed, a reaction force is low enough not to affect a switch-operating feeling.

DETAILED DESCRIPTION OF THE PREFERRED EMBODIMENTS

Preferred embodiments of the present invention will now be described in detail with reference to FIGS. 1 to 10.

A switch device of this embodiment is so constructed that a foreign matter (such as dust, dirt and a water droplet) can be positively prevented from intruding into a gap or space between an display switch button and a display screen from the outer periphery of the display switch button. The construction of the switch device, capable of achieving such effects, will be described below.

1. Construction of Switch Device

Figure 1:
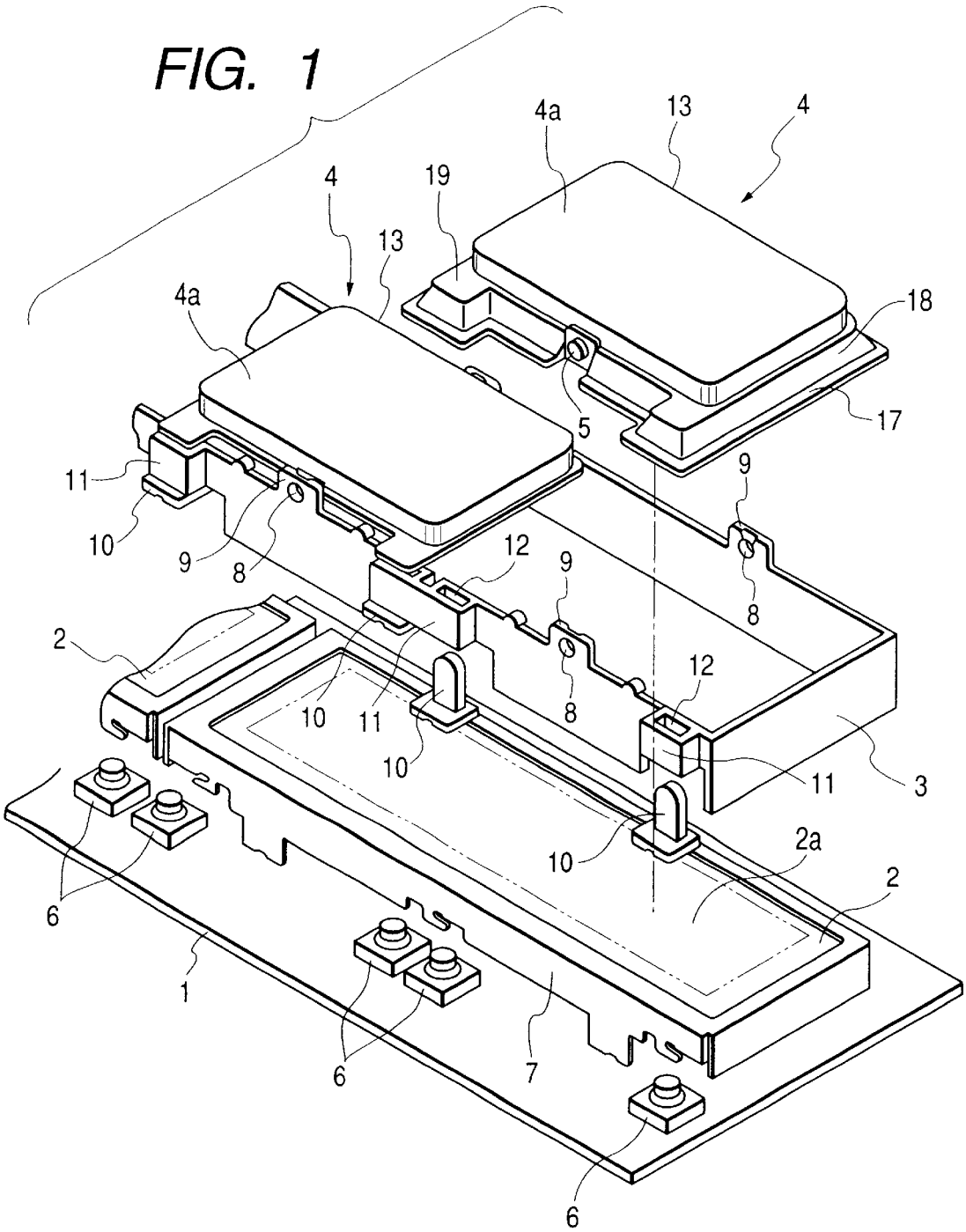
FIG. 1 is an exploded, perspective view of a preferred embodiment of a switch device of the present invention.
Figure 2:
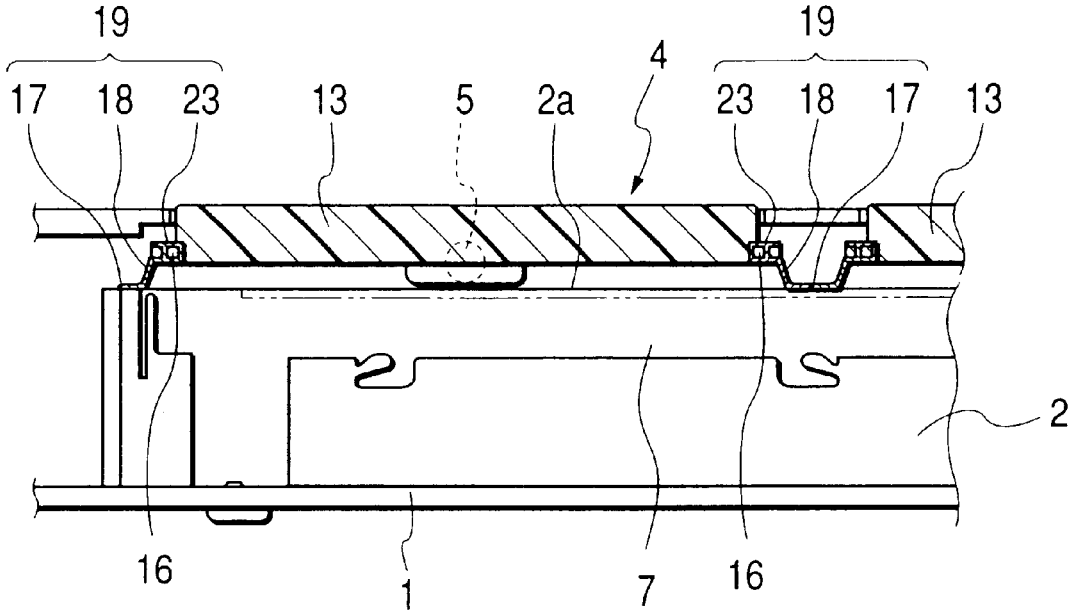
FIG. 2 is a cross-sectional view of an important portion of the switch device in an initial condition in which a key member is not pressed.
Figure 3:
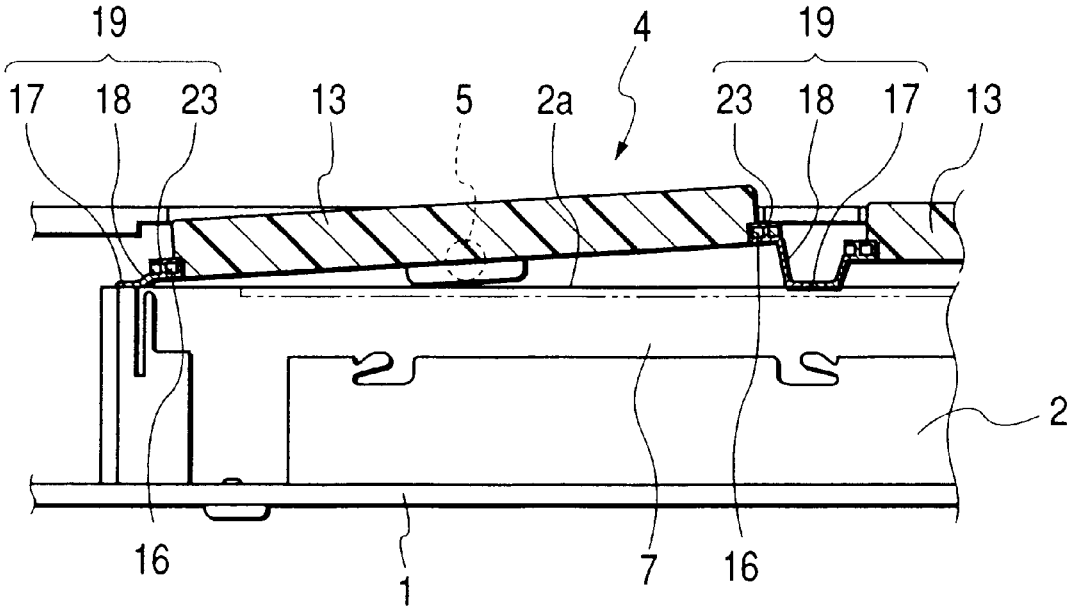
FIG. 3 is a cross-sectional view of the important portion of the switch device in a condition in which the key member is pressed.
Figure 4:
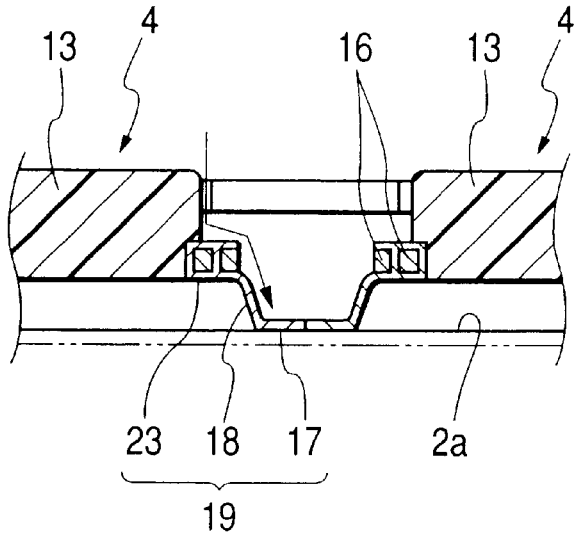
FIG. 4 is an enlarged, cross-sectional view of an important portion of the switch device, showing the manner of preventing dust or others from intruding to deposit on a display screen of a display.
Figure 5:
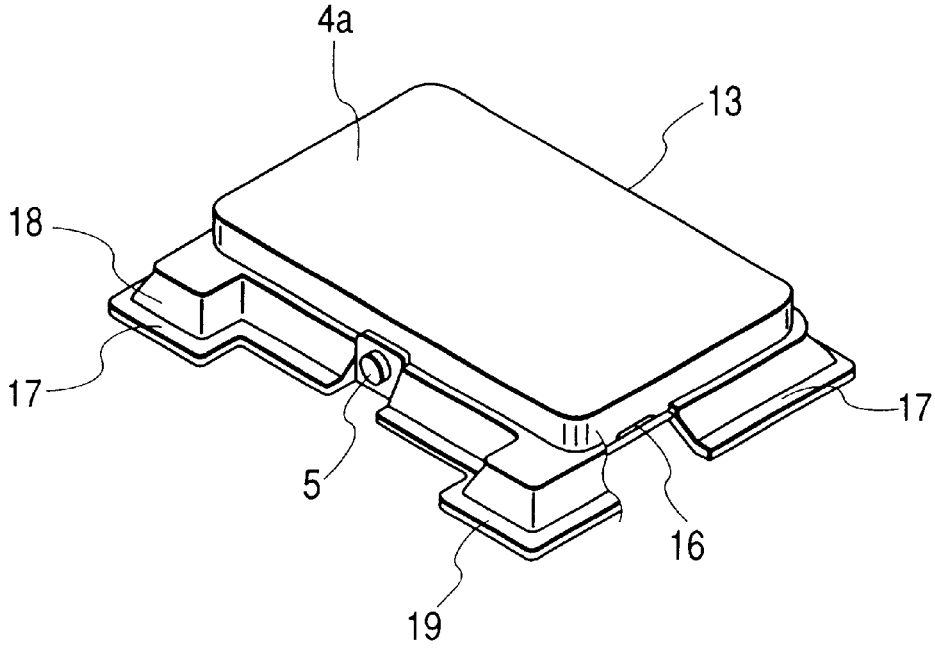
FIG. 5 is a perspective view of the key member.

As shown in FIGS. 1 and 2, the switch device of this embodiment is a so-called see-saw-type switch, and a display switch button-mounting holder 3 is provided in surrounding relation to an outer periphery of a display (image display device) 2 mounted on a printed circuit board 1, and key members 4, capable of effecting transmitting display, are mounted on this holder 3 in such a manner that each key member 4 can be pivotally moved right and left or upward and downward about a pair of support shafts 5.

2. Constructions of Printed Circuit Board, Switch and Display Switch Button-mounting Holder As shown in FIGS. 1 and 2, a drive circuit portion (not shown) for driving the display 2, and a plurality of switches 6, which are turned on and off by the key members 4, are mounted on the printed circuit board 1. Each of the switches 6 comprises, for example, a switch contact such as a metal dome, and the switches 6 are arranged at predetermined intervals along one side of the display 2.

The display 2, serving as an image display device, comprises, for example, a liquid crystal display (LCD) or an electroluminescent (EL) display, and this display 2 graphically displays image information (including character information) of various functions on a display screen 2*a*(indicated in two dots-and-dash line in FIG. 1). The display 2 is mounted on the printed circuit board 1 through a display-mounting frame 7.

When each switch 6 is pressed by the corresponding key member 4, an equipment (e.g. an on-board audio system) is instantaneously switched into a corresponding mode, and the image information, corresponding to this mode, is graphically displayed on a desired portion of the display screen 2*a*. The image information, displayed on the display screen 2*a*, is transmitted through the key member 4, and can be viewed at a display portion 4*a* (i.e., key top) of the key member 4.

As shown in FIG. 1, the display switch button-mounting holder 3 is in the form of a frame surrounding the outer periphery of the display 2, and this holder 3 supports the key members 4 in such a manner that each key member 4 can be pivotally moved (in a see-saw manner) about the support shafts 5. Support shaft-holding portions 9 are formed on the display switch button-mounting holder 3, and each of these holding portions 9 has a holding hole 8 which holds the support shaft 5 of the key member 4.

As shown in FIG. 1, switch depressing member-holding portions 11 are formed on the display switch button-mounting holder 3, and switch depressing members 10 for respectively pressing the switches 6, mounted on the printed circuit board 1, are supported by these holding portions 11 for upward and downward movement. A hole 12 is formed through each switch depressing member-holding portion 11 in an upward-downward direction, and the switch depressing member 10 is received in this hole 12 so as to be moved upward and downward in a guided manner.

3. Construction of Key Member

As shown in FIGS. 5 to 9, the key member 4 functions to transmit the image information, displayed on the display screen 2*a*, therethrough so as to display this image information on the display portion 4*a*, and also functions to operate the plurality of switches 6. The key member 4 includes a display switch button 13, capable of transmitting the image information therethrough so as to display this image information on an outer side thereof defining the display portion 4*a*, a button mounting frame 16, which has switch depressing portions 14 for respectively turning on and off the switches 6, and also has a button mounting hole portion 15 having the display switch button 13 mounted therein, and a waterproof dust cover 19 of a rubber material which is molded integrally on the button mounting frame 16 to cover the same, and includes a support portion 17 for intimate contact with the display screen 2*a*, and a contractible skirt portion 18.

Incidentally, the key member 4 may be partially made of a transparent material so that the image information can be transmitted through the display switch button 13. Moreover, the display switch button 13 may have partially transparency, although that region of the display portion 4*a*, on which the image information can be displayed, is restricted. Of course, the key member 4 may be entirely made of a transparent material.

In this embodiment, the display switch button 13 is made of a resin material capable of transmitting the image information displayed on the display screen 2*a*, so that the image information can be displayed on the display portion 4*a*. For example, the display switch button 13 is formed into a rectangular shape, using an acrylic resin (PMMA), a polycarbonate resin (PC) or the like. A step portion 20 is formed at a lower surface of the display switch button 13 at an outer peripheral edge thereof, and as a result the display switch button 13 has a fitting portion 21 which is fitted in the button mounting hole 15 formed in the button mounting frame 16.

Figure 9:
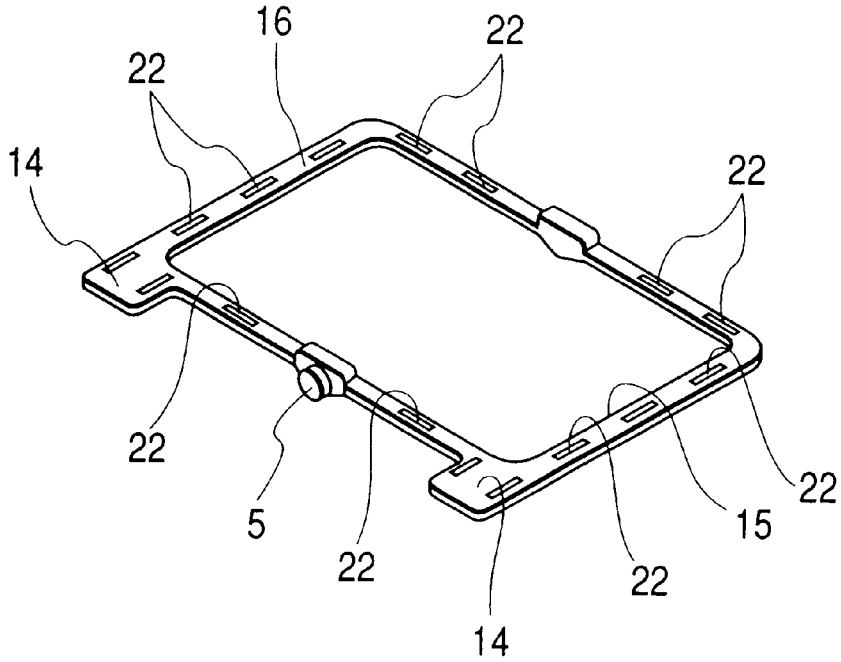
FIG. 9 is a perspective view of the button mounting frame.

As shown in FIG. 9, the button mounting frame 16 is in the form of a rectangular frame having the button mounting hole 15 into which the fitting portion 21 is fitted. The switch depressing portions 14 and 14 for respectively depressing the switches 6 are formed respectively at opposite ends of one side edge of the button mounting frame 16. The support shafts 5 are formed on the button mounting frame 16, and these support shafts 5 are respectively inserted in and supported by the holding holes 8 formed in the display switch button-mounting holder 3.

A plurality of resin filling holes 22 are formed in the button mounting frame 16 so that the waterproof dust cover 19 of a rubber material (described later) can be molded integrally on this button mounting frame 16. For example, the resin filling holes 22 have a rectangular shape, and are arranged at predetermined intervals. Generally, a resin material and a rubber material can not be formed integrally with each other by molding, and therefore the resin filling holes 22 are formed in the button mounting frame 16, and the resin material and the rubber material are formed integrally with each other while filling the rubber material in the resin filling holes 22.

The button mounting frame 16 is smaller in thickness than the display switch button 13, and therefore is molded of a resin material, having high rigidity and excellent heat resistance, in order to increase a mechanical strength thereof. Since the waterproof dust cover 19 is molded integrally on the button mounting frame 16, this button mounting frame 16 is molded of the resin material having a higher heat-resistance temperature than that of the rubber material forming the waterproof dust cover 19. A temperature of a mold for molding the rubber material is 160° or more, and a temperature of about 160° to about 200° is required for curing, and therefore glass-reinforced PBT (glass fiber-type polyethylene terephthalate) or the like, having a sufficient heat resistance to withstand such temperature, is used as the resin material for forming the button mounting frame 16.

Figure 6:
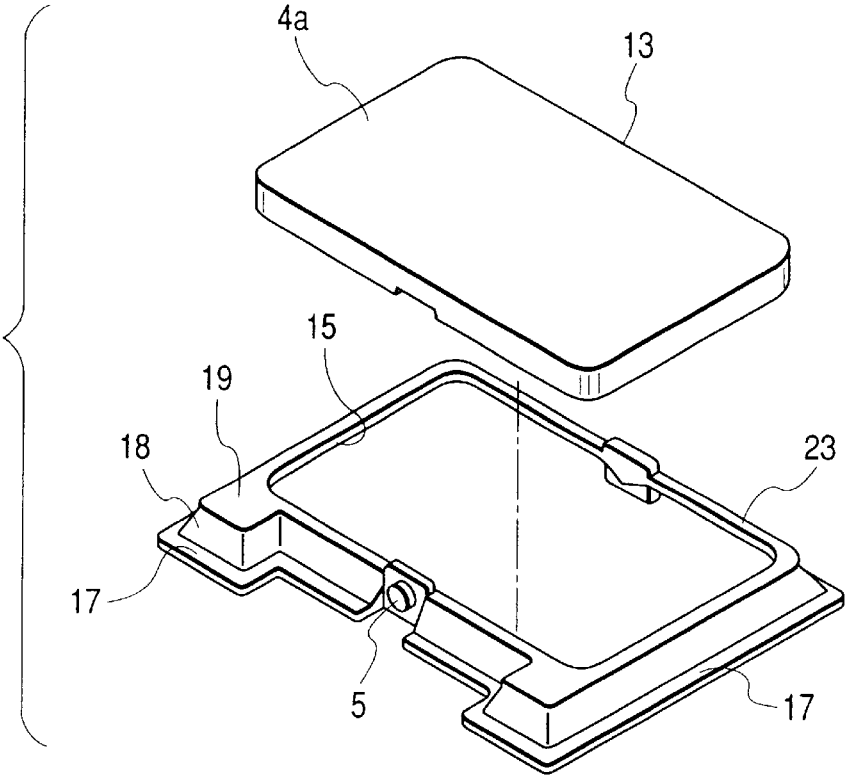
FIG. 6 is an exploded, perspective view of the key member.
Figure 7:
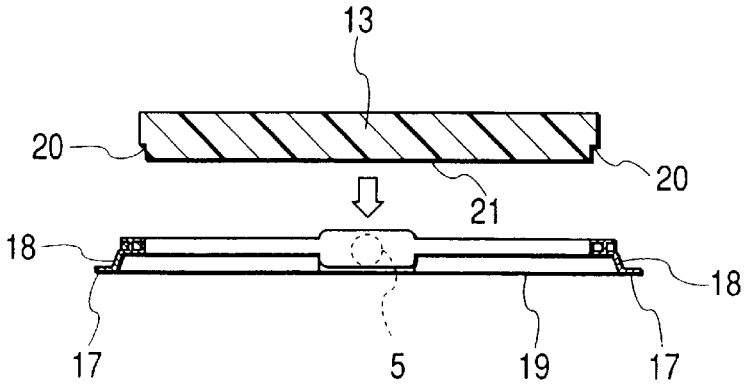
FIG. 7 is an exploded, cross-sectional view of the key member.
Figure 8:
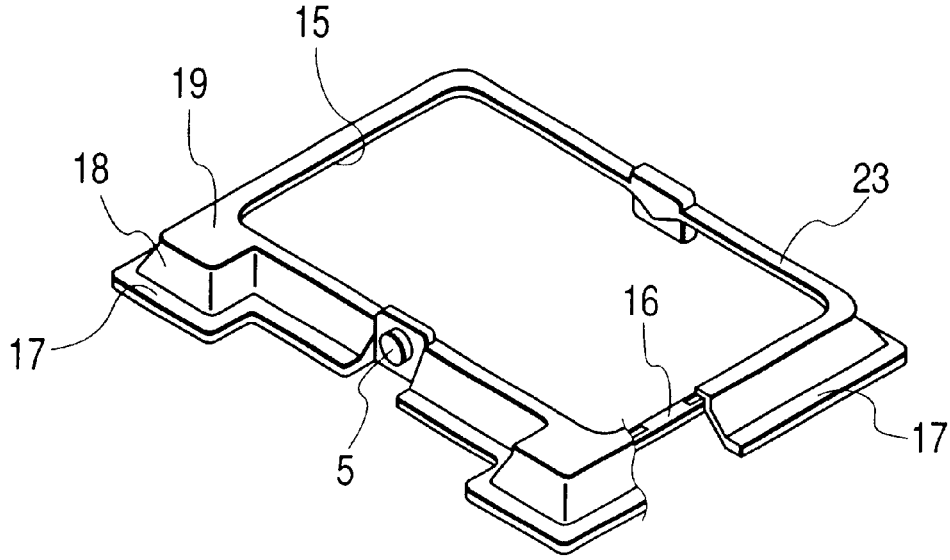
FIG. 8 is a partly-broken, perspective view showing a condition in which a waterproof dust cover is molded integrally on a button mounting frame.

As shown in FIGS. 6 to 8, the waterproof dust cover 19 includes the support portion 17 for intimate contact with the display screen 2*a* of the display 2, the contractible skirt portion 18, and a cover portion 23 which covers the button mounting frame 16. The cover portion 23 is filled in the resin filling holes 22, and covers the button mounting frame 16.

The skirt portion 18 is formed along an outer peripheral edge of the button mounting portion 16 at a lower side thereof, and extends obliquely downwardly in a generally flaring manner. This skirt portion 18 is smaller in thickness than the cover portion 23 and the support portion 17 so that the key member 4 can be moved in the range of a switch stroke, and that its reaction force can be sufficiently reduced not to adversely affect a switch-operating feeling.

The support portion 17 is in the form of a flange formed along an outer peripheral edge of a lower portion of the skirt portion 18, and extends horizontally outwardly therefrom. This support portion 17 is adapted to be held in intimate contact with the display screen 2*a* of the display 2.

For producing the key member 4 comprising the above three parts, that is, the button mounting frame 16 is molded of the resin material having high heat resistance, and then this button mounting frame 16 is set in a mold for molding the waterproof dust cover 19, and then the waterproof dust cover 19 is formed. Then, the display switch button 13 is press-fitted into the button mounting hole 15 in the button mounting frame 16, having the waterproof dust cover 19 formed integrally therewith, to be fixed thereto, thereby producing the key member 4.

Thus, the waterproof dust cover 19 is formed integrally on the button mounting frame 16, and the display switch button 13 is press-fitted into the button mounting hole 15 in the button mounting frame 16 to be fixed thereto, and as a result the display switch button 13 is in intimate contact with the inner surface (or edge) of the button mounting hole 15 through the compressed rubber, thereby forming a seal therebetween.

4. Operation of Switch Device

Next, the operation of the switch device of the above construction will be described. In the initial condition of FIG. 2 (in which any switch is not depressed), the support portion 17 of the waterproof dust cover 19 is held in intimate contact with the display screen 2*a* of the display 2. Therefore, even when a foreign matter, such as dirt, dust and a water droplet, intrudes through a gap at the outer periphery of the display switch button 13 as indicated by an arrow in FIG. 4, the support portion 17 prevents the intrusion of the foreign matter (such as dust and dirt), thus preventing this foreign matter from depositing on the display screen 2*a*.

Then, in the initial condition of FIG. 2, when the display switch button 13 is pressed, that side portion of the skirt portion 18, pressed through this button 13, is contracted whereas the opposite side portion of the skirt portion 18 is expanded, with the support portion 17 kept in intimate contact with the display screen 2*a*. Thus, even when the skirt portion 18 is expanded upon pressing of the display switch button 13, the support portion 17 is held in intimate contact with the display screen 2*a*, and therefore a foreign matter, such as dust, dirt and a water droplet, will not intrude into a gap or space between the display screen 2*a* and the display switch button 13. Therefore, the user will not recognize any foreign matter (such as dirt, dust and a water droplet) on the display screen 2*a*, and can always view the clear image information.

5. Another Embodiment

Although one preferred embodiment of the present invention has been described above, the present invention is not limited to the above embodiment, but various modifications can be made.

In the above embodiment, although the key member 4 comprises the three parts, that is, the display switch button 13, the button mounting frame 16 and the waterproof dust cover 19, the key member 4 may comprises two parts, that is, the waterproof dust cover 19 and a one-piece part formed by molding the display switch button 13 and the button mounting frame 16 integrally with each other.

Figure 10:
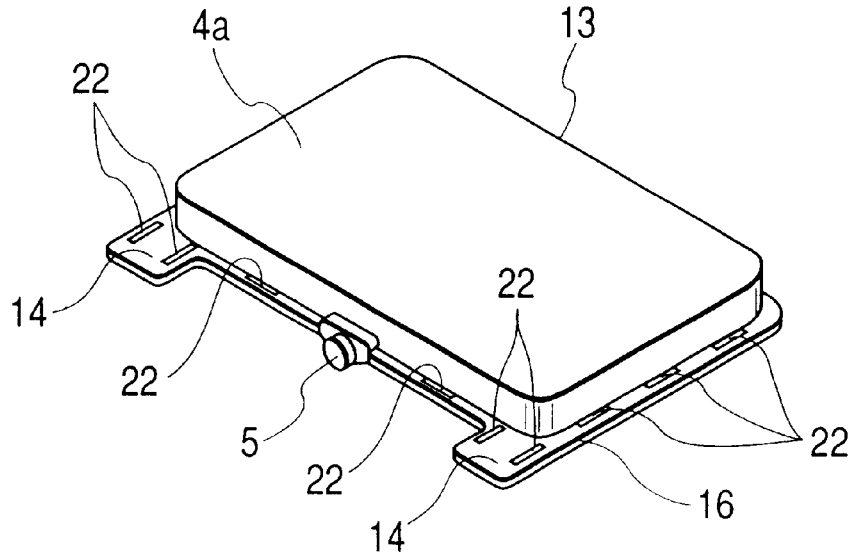
FIG. 10 is a perspective view showing a condition in which a display switch button and a button mounting frame are molded integrally with each other.
Figure 11:
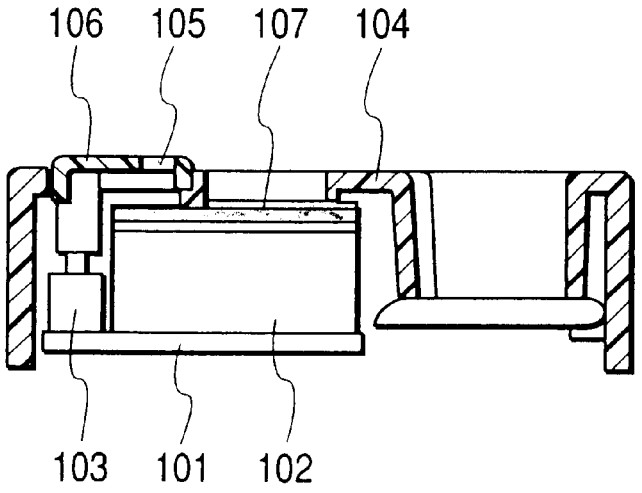
FIG. 11 PRIOR ART
FIG. 11 is a cross-sectional view of a conventional switch device.

For example, as shown in FIG. 10, a button mounting frame 16, having switch depressing portions 14, is molded integrally on an outer peripheral portion of a display switch button 13. This display switch button 13, having the button mounting frame 16 integrally molded thereon, is molded of an acrylic resin (PMMA), a polycarbonate resin (PC) or the like which is capable of transmitting image information, and has high heat resistance.

In view of the heat resistance of the above acrylic resin, polycarbonate resin or the like, the waterproof dust cover 19 is molded of a thermoplastic elastomer, having elasticity as of rubber, so that the display switch button 13 and the button mounting frame 16 will not melt. For example, this thermoplastic elastomer exhibits a heat-resistance temperature lower than a heat-resistance temperature of the acrylic resin and the polycarbonate resin which is 100° to 140°, and therefore the acrylic resin and the polycarbonate resin will not melt. And besides, when the thermoplastic elastomer is thus used to form the water dust cover 19, the thermoplastic elastomer is smoothly fitted in resin filling holes 22 formed in the button mounting frame 16. Preferably, urethane elastomer is used as the thermoplastic elastomer.

For producing a key member 4 of this embodiment, the display switch button 13 is molded of an acrylic resin or the like in such a manner that the button mounting frame 16 is formed integrally on the outer peripheral edge of the display switch button 13, as shown in FIG. 10. Then, this display switch button 13 is set in a mold for molding the waterproof dust cover 19, and the thermoplastic elastomer is poured into this mold. As a result, there is produced the key member 4 having the waterproof dust cover 19 of the thermoplastic elastomer integrally formed with the button mounting frame 16 to cover the same. The thus produced key member 4 has the same final form as that of the key member 4 of FIG. 5 comprising the three parts.

In each of the above embodiments, the present invention is applied to the see-saw-type switch, but can be applied also to a push-type switch, in which case similar effects can be obtained.

The present invention is carried out in the above-mentioned mode, and achieves the following effects.

In the switch device of the present invention, the waterproof dust cover, made of the rubber material, is mounted on the outer periphery of the display switch button, capable of transmitting the image information therethrough so as to display this image information on the outer side thereof, and this waterproof dust cover is molded integrally on the button mounting frame, having the button mounting hole portion having said display switch button mounted therein, to cover the button mounting frame. The support portion of the waterproof dust cover is held in intimate contact with the display screen, and therefore this waterproof dust cover prevents the intrusion of a foreign matter, such as dust, dirt and a water droplet, into the gap between the display screen and the display switch button, thereby providing the user with the clear display screen free from dust, dirt and so on.

In the switch device of the present invention, the plurality of resin filling holes are formed in the button mounting frame, and the rubber material, forming the waterproof dust cover, is filled in the resin filling holes. With this construction, the button mounting frame of the resin and the waterproof dust cover of the rubber material, which are usually not bonded together, are firmly combined together to provide an integral construction, and therefore the efficiency of the assembling operation is enhanced.

In the switch device of the present invention, the display switch button is press-fitted in the button mounting hole portion covered with the rubber, and therefore the display switch button is held in intimate contact with the rubber at this press-fitted portion, so that the intrusion of a foreign matter, such as dirt, dust and a water droplet, through this press-fitted portion, is prevented.

In the switch device of the present invention, the button mounting frame is formed by the resin material whose heat-resistance temperature is higher than that of the rubber material forming the waterproof dust cover, and therefore the rigidity of the button mounting frame is increased, and the sufficient mechanical strength can be secured. And besides, since the button mounting frame is smaller in thickness than the display switch button, the reliability of the switch itself can be enhanced by increasing the rigidity of the button mounting frame.

In the switch device of the present invention, the button mounting frame is formed integrally on the outer periphery of the display switch button, and the waterproof dust cover, made of the elastic material (thermoplastic elastomer), is molded integrally on the button mounting frame to cover the same, and the support portion of the waterproof dust cover is held in intimate contact with the display screen. Therefore, this waterproof dust cover prevents a foreign matter, such as dust, dirt and a water droplet, from intruding into the gap between the display screen and the display switch button, thereby providing the user with the clear display screen free from dust, dirt and so on.

In the switch device of the present invention, the waterproof dust cover is made of the thermoplastic elastomer, and therefore the display switch button and the button mounting frame, which are integrally molded together, will not melt when molding the waterproof dust cover.

In the switch device of the present invention, the plurality of resin filling holes are formed in the button mounting frame, and the thermoplastic elastomer, forming the waterproof dust cover, is filled in the resin filling holes. Therefore, the button mounting frame of the resin and the waterproof dust cover of the rubber material, which are usually not bonded together, are firmly combined together through this thermoplastic elastomer to provide an integral construction. Thus, the button mounting frame and the waterproof dust cover are combined into an integral construction, and therefore the efficiency of the assembling operation is much enhanced.

In the switch device of the present invention, the skirt portion is smaller in thickness than the remainder, and therefore when the display switch button is pressed, a reaction force is low enough not to affect a switch-operating feeling.

What is claimed is:

1. A switch device, comprising:

a key member located above a display screen of an image display device which is capable of displaying image information on the display screen, the key member being capable of transmitting the image information therethrough so as to display the image information on an outer side surface thereof, the key member comprising:

a display switch button, a button mounting frame, which includes a switch depressing portion operative to switch a switch when the key depressing portion is depressed, and which has a button mounting hole portion to which the display switch button is attached, and a waterproof dust cover of a rubber material, which is molded integrally on the button mounting frame to cover the button mounting frame, and which includes a support portion held in intimate contact with the display screen, and a contractible skirt portion, wherein a plurality of resin filling holes are formed in the button mounting frame, and wherein the rubber material, forming the waterproof dust cover, is filled in the resin filling holes.

2. The switch device of claim 1, wherein the display switch button includes a transparent portion through which the image information is transmitted so as to display the image information on the outer side surface of the key member.

3. The switch device of claim 1, wherein the button mounting frame is associated with the display switch button to switch the switch.

4. The switch device of claim 1, wherein the display switch button is press-fitted in the button mounting hole portion covered with the rubber.

5. The switch device of claim 1, wherein a heat-resistance temperature of a resin material, forming the button mounting frame, is higher than a heat-resistance temperature of the rubber material forming the waterproof dust cover.

6. The switch device of claim 1, wherein the skirt portion is smaller in thickness than a remaining portion of the waterproof dust cover.

7. A switch device, comprising:

a key member located above a display screen of an image display device which is capable of displaying image information on the display screen, the key member being capable of transmitting the image information therethrough so as to display the image information on an outer side surface thereof, the key member comprising:

a display switch button, a button mounting frame, which includes a switch depressing portion operative to switch a switch when the key depressing portion is depressed, and which is molded integrally on an outer periphery of the display switch button, and a waterproof dust cover of a thermoplastic elastomer, which is molded integrally on the button mounting frame to cover the button mounting frame, and which includes a support portion held in intimate contact with the display screen, and a contractible skirt portion, wherein a plurality of resin filling holes formed in the button mounting frame, and the thermoplastic elastomer is filled in the resin filling holes.

8. The switch device of claim 7, wherein the display switch button includes a transparent portion through which the image information is transmitted so as to display the image information on the outer side surface of the key member.

9. The switch device of claim 7, wherein the button mounting frame is associated with the display switch button to switch the switch.

10. The switch device of claim 7, wherein the skirt portion is smaller in thickness than a remaining portion of the waterproof dust cover.

* * * * *